US009051159B2

(12) United States Patent
Walker et al.

(10) Patent No.: US 9,051,159 B2
(45) Date of Patent: Jun. 9, 2015

(54) COLUMN CONNECTOR SYSTEM

(71) Applicant: Manitowoc Crane Companies, LLC, Manitowoc, WI (US)

(72) Inventors: Robert J. Walker, Manitowoc, WI (US); David J. Pech, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 0 days.

(21) Appl. No.: 14/109,099

(22) Filed: Dec. 17, 2013

(65) Prior Publication Data

US 2014/0174018 A1 Jun. 26, 2014

Related U.S. Application Data

(60) Provisional application No. 61/740,256, filed on Dec. 20, 2012.

(51) Int. Cl.
*B66C 23/70* (2006.01)

(52) U.S. Cl.
CPC ..... *B66C 23/70* (2013.01); *Y10T 403/553* (2015.01)

(58) Field of Classification Search
CPC ..... B66C 23/82; B66C 23/70; Y10T 29/49; Y10T 29/49826; Y10T 29/49947; Y10T 29/4978; Y10T 403/18; Y10T 403/553; Y10T 403/7075
USPC ..... 52/637, 650.1, 651.05, 848; 212/177, 212/299, 300, 347, 350; 403/294, 378, 364, 403/408.1, 300, 308
See application file for complete search history.

(56) References Cited

U.S. PATENT DOCUMENTS 2,529,454 A 11/1950 Marcantonio
2,975,910 A * 3/1961 Conrad ..... 212/300
(Continued)

FOREIGN PATENT DOCUMENTS

DE 3706301 C1 * 10/1987 ..... B66C 23/64
DE 4402005 A1 7/1995
(Continued)

OTHER PUBLICATIONS

Liebherr LR13000 Welded Boom Connector (Feb. 14, 2011).
(Continued)

*Primary Examiner* — Brent W Herring
(74) *Attorney, Agent, or Firm* — Craig Buschmann; Brinks Gilson & Lione

(57) ABSTRACT

A connector for a column segment, such as a boom segment, of a crane includes n extensions, where n is a positive integer. Each extension has a first base and an aperture extends through the extension from a first side to a second side. The first connector also includes at least (n+y) plates, where y is selected from the group consisting of (−1, +1) such that the sum of (n+y) is a positive integer. The plate or plates are positioned in and coupled to the extensions in an alternating arrangement. Each plate includes a plate base aligned substantially in a plane with the first base of the extension to form a first connector mounting surface. A plurality of welds couple the plates to the extensions and the fabricated connector is then welded to the column segment. At least one extension is formed of steel having a grain structure elongated in a direction of rolling that is substantially perpendicular to the first base.

20 Claims, 8 Drawing Sheets

(56) References Cited

U.S. PATENT DOCUMENTS

| | | | | |
|---|---|---|---|---|
| 3,085,695 | A | 4/1963 | Miller | |
| 3,430,778 | A | 3/1969 | Brown | |
| 3,955,684 | A | 5/1976 | Novotny | |
| 3,977,530 | A | 8/1976 | Helm et al. | |
| 4,081,081 | A | 3/1978 | Morrow, Sr. et al. | |
| 4,273,244 | A | 6/1981 | Jensen et al. | |
| 4,582,205 | A | 4/1986 | Berger et al. | |
| 5,082,128 | A * | 1/1992 | Franzen et al. | 212/347 |
| 5,199,586 | A | 4/1993 | Pech et al. | |
| 5,443,169 | A | 8/1995 | Pagel et al. | |
| 5,484,069 | A | 1/1996 | Lanning | |
| 6,062,405 | A | 5/2000 | Pech et al. | |
| 6,089,388 | A | 7/2000 | Willim | |
| 6,131,751 | A | 10/2000 | Pech et al. | |
| 6,213,318 | B1 | 4/2001 | Walker | |
| 6,481,202 | B1 | 11/2002 | Zuehlke et al. | |
| 6,588,521 | B1 | 7/2003 | Porubcansky et al. | |
| 6,702,132 | B1 | 3/2004 | Moore et al. | |
| 7,007,764 | B2 | 3/2006 | Smith et al. | |
| 7,270,243 | B2 | 9/2007 | Diehl | |
| 7,503,623 | B2 * | 3/2009 | Favaretto | 296/203.01 |
| 7,546,928 | B2 | 6/2009 | Pech et al. | |
| 7,565,982 | B2 | 7/2009 | Kurotsu et al. | |
| 7,762,412 | B2 | 7/2010 | Porubcansky | |
| 7,954,657 | B2 | 6/2011 | Holly et al. | |
| 7,967,158 | B2 | 6/2011 | Pech et al. | |
| 8,534,474 | B2 | 9/2013 | Holly et al. | |
| 8,622,228 | B2 | 1/2014 | Mentink et al. | |
| 8,739,988 | B2 * | 6/2014 | Walker | 212/177 |
| 2002/0053551 | A1 | 5/2002 | Koster et al. | |
| 2006/0065616 | A1 | 3/2006 | Diehl | |
| 2007/0256999 | A1 | 11/2007 | Kurotsu et al. | |
| 2008/0099421 | A1 | 5/2008 | Pech et al. | |
| 2008/0173605 | A1 | 7/2008 | Willim | |
| 2008/0203045 | A1 | 8/2008 | Pech et al. | |
| 2008/0264887 | A1 | 10/2008 | Porubcansky | |
| 2010/0260539 | A1 * | 10/2010 | Sakamoto et al. | 403/294 |
| 2010/0326004 | A1 | 12/2010 | Daas et al. | |
| 2011/0233165 | A1 | 9/2011 | Holly et al. | |
| 2011/0284490 | A1 | 11/2011 | Liu et al. | |
| 2012/0067840 | A1 | 3/2012 | Walker | |
| 2012/0175333 | A1 * | 7/2012 | Pech et al. | 212/177 |
| 2013/0270208 | A1 * | 10/2013 | Walker et al. | 212/177 |

FOREIGN PATENT DOCUMENTS

| | | | |
|---|---|---|---|
| EP | 0376417 | A1 | 7/1990 |
| EP | 0533323 | A1 | 3/1993 |
| EP | 1205421 | A1 | 5/2002 |
| EP | 1468955 | A1 | 10/2004 |
| EP | 2431322 | A1 | 3/2012 |
| FR | 2519620 | A1 | 7/1983 |
| JP | 1988-212692 | A | 5/1988 |
| JP | 1990-225294 | A | 7/1990 |
| JP | 09156882 | | 6/1997 |
| JP | 2004-189496 | A | 8/2004 |
| NL | 1035078 | C1 | 3/2008 |
| SU | 1801180 | A3 | 3/1993 |

OTHER PUBLICATIONS

Mammoet Connector PTC120DS Boom Photos2 (May 18, 2011).

EP Search Report, dated Mar. 12, 2014, for EP 13197111.1 (related application).

Brochure, "HC-238, 125-Ton Truck Crane" 3 pages (undated but prior to Nov. 29, 2007).

Brochure for Manitowoc 4100 Crane, 1 page (undated but prior to Sep. 16, 2009).

European Search Report for related European Application No. 14184310.2, dated Nov. 27, 2014 (5 pages).

Liebherr LR11350—four photographs of load, boom and mast hoist drum mounting (undated but prior to Sep. 16, 2009).

Manitowoc 16000—three photographs of load and mast hoist drums (undated but prior to Sep. 16, 2009).

Pages from "LR1600/2 Crawler Crane—Technical Data," Liebherr, pp. 1-10 (undated but prior to Sep. 16, 2009).

* cited by examiner

FIG. 6
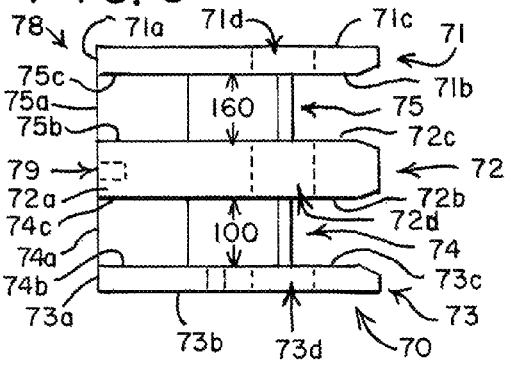
FIG. 8
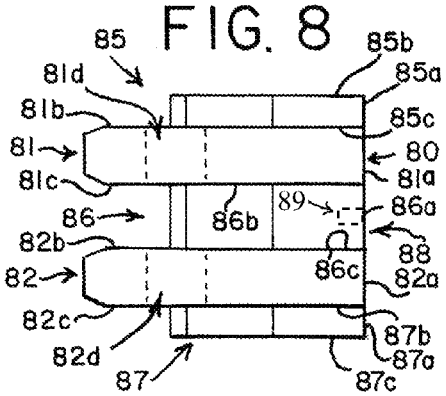
FIG. 7
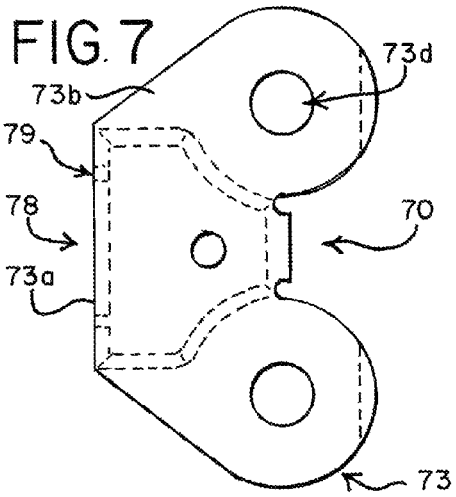
FIG. 9
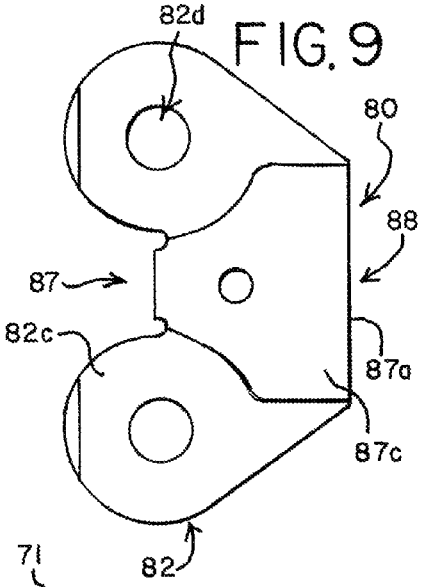
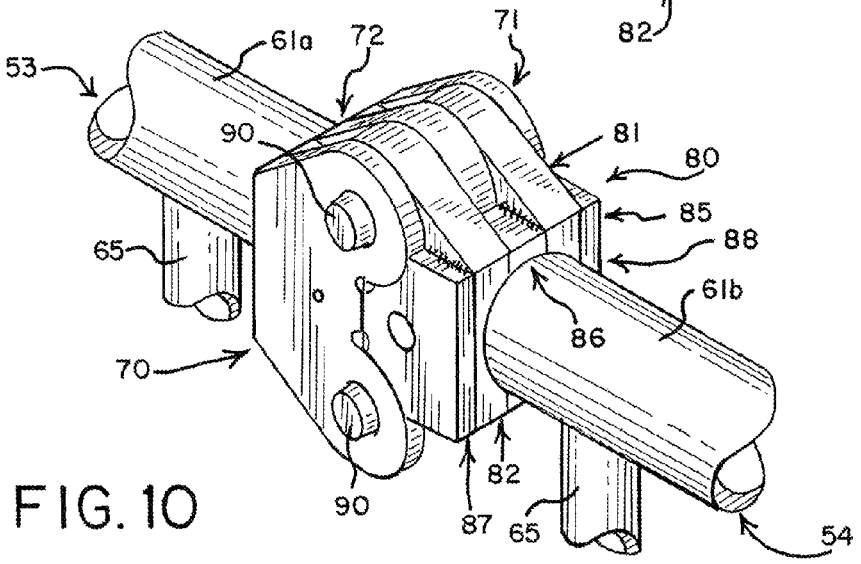
FIG. 10

COLUMN CONNECTOR SYSTEM

RELATED APPLICATION

The present patent document claims the benefit of priority to U.S. Provisional Patent Application No. 61/740,256, filed Dec. 20, 2012, and entitled "COLUMN CONNECTOR SYSTEM," the entire contents of each of which are incorporated herein by reference.

BACKGROUND

The present invention relates to lift cranes, and more particularly to connectors for coupling adjacent segments or sections of a column, such as a column used as a boom for cranes and the like.

Large capacity lift cranes typically have elongate load supporting column structures, commonly used for boom, mast, or jib, that comprise sectional column members secured in end-to-end abutting relationship. Predominantly, each of the column members is made of a plurality of chords and lacing or lattice elements. The terminal end portions of each chord are generally provided with connectors of one form or another to secure abutting column segments together and to carry compressive loads between abutting chords. Typical connectors comprise one or more extensions and plates secured by a pin carrying compressive loads in double shear.

An example 220 foot boom may be made of a 40 foot boom butt pivotally mounted to the crane upper works, a 30 foot boom top equipped with sheaves and rigging for lifting and supporting loads, with five sectional boom members in between: one 10 feet in length, one 20 feet in length and three 40 feet in length. Such an example boom has six boom segment connections. Typically each segment has four chords, and hence four connectors, making a total of 24 connectors that must be aligned and pinned to assemble the boom.

Typically, the loads carried by the boom members and, consequently, through the connectors require the lugs, also referred to as extensions, on the connector to be sufficiently thick to have sufficient strength to bear the loads. To carry very high loads for a high capacity crane, a typical single extension sandwiched between two plates, giving a double shear connection, requires a very large pin diameter to carry the compressive loads and, consequently, requiring the connectors to be very large. Standard specification plate steel often is insufficiently thick to form the extensions on a connector having sufficient strength to support the loads. For example, 100,000 pound per square inch (100 kpsi) plate steel is available in 4 inch thick plates and 130 kpsi plate steel is available in 2¾ inch thick plates, but neither is sufficiently thick in itself to form a connector capable of carrying the highest loads. While higher strength steel plates of greater thickness may be available, obtaining it typically requires a special order with a steel mill at commensurately higher costs and lead times. As a consequence, the connectors typically are formed of cast steel so as to have a sufficient thickness and strength.

Casting a connector, however, poses several challenges and inefficiencies. First, qualifying a foundry, preparing a mold, and casting a connector are a time intensive and, consequently, costly processes. Indeed, a long lead time and significant work may be invested in preparing a mold before the first connector can be cast. Provided a production run is sufficiently large it may make sense to mold many connectors, but only a small number of the largest cranes with the largest connectors in terms of both size and overall number may be manufactured.

Further, because of the long lead times and high costs of casting, the process is not easily adaptable to engineering and design changes, prototype testing, and the manufacture of one or a small number of components for use in destructive testing or as replacement parts. Stated differently, as a manufacturing process, the process of casting connectors often is not sufficiently agile and adaptable to rapidly changing business conditions and requirements.

Another disadvantage of cast connectors is that casting defects are not uncommon. As a consequence, a cast connector may require finish work or machining to ensure that a connector falls within the required specification and tolerances for a given application. This finish work often can be time consuming and expensive, too.

As a result, there exists a need for a connector that is quicker and easier to manufacture than a cast connector.

BRIEF SUMMARY

A column segment of a column of a crane includes a plurality of chords, each chord having a first end a second end. An embodiment of a connector is fabricated from two or more metal plates.

A first connector on the second end of at least one of the cords includes n extensions, where n is a positive integer, e.g., 1, 2, 3, and so on. Each extension has a first base and a first side extending away from the first base. A second side also extends away from the first base and is spaced apart from the first side. An aperture extends through the extension from the first side to the second side.

The first connector also includes at least (n+y) plates, where y is selected from the group consisting of (−1, +1) such that the sum of (n+y) is a positive integer. The plate or plates are positioned in and coupled to the extensions in an alternating arrangement. Each plate includes a plate base aligned substantially in a plane with the first base of the extension to form a first connector mounting surface. Each plate also includes a first plate side extending away from the plate base, the first plate side being positioned adjacent to one of the first side and the second side of one of the extensions. Each plate also includes a second plate side extending away from the plate base, the second plate side being spaced apart from the first plate side.

In some embodiments, a plurality of welds couples the plates to the extensions. Optionally, the fabricated connector is then welded to the column segment.

In some embodiments, the at least one extension is formed of steel having a grain structure elongated in a direction of rolling that is substantially perpendicular to the first base.

In an embodiment of a column connector system, the connector system includes a first column segment having a first end and a second end and at least a second column segment also having a first end and a second end. A first connector on the second end of the first column segment includes at least two exterior extensions, each extension having a first base, a first side perpendicular to the first base, and a second side spaced apart from the first side and also perpendicular to the first base. A first aperture extends through each of the exterior extensions.

The first connector also includes at least one interior plate coupled to at least one of the exterior extensions. The interior plate includes an interior plate base aligned substantially in a plane with the first base to form a first connector mounting surface. A first interior plate side is perpendicular to the interior plate base and positioned adjacent to one of the first side and the second side of one of the exterior extensions. A second interior plate side also is perpendicular to the interior plate base and is spaced apart from the first interior plate side.

The connector system also includes a second connector on the first end of the second column segment. The second connector includes at least one interior extension having a second base, a first side perpendicular to the second base, a second side also perpendicular to the second base and spaced apart from the first side, and a second aperture through the interior extension.

The second connector also includes a first exterior plate and a second exterior plate, at least one of the first exterior plate and the second exterior plate being coupled to the at least one interior extension. Each of the exterior plates has an exterior plate base aligned substantially in a plane with the second base of the at least one interior extension to form a second connecting mounting surface of the second connector. Each exterior plate also includes a first exterior plate side perpendicular to the exterior base plate and a second exterior plate side also perpendicular to the exterior base and spaced apart from the first exterior plate side.

A pin inserted through the first aperture of each exterior extension and the second aperture of each interior extension of the first and second connector couples the first connector to the second connector.

In some embodiments, the first connector includes a plurality of welds that couple the interior plate to the exterior extensions and the second connector includes a plurality of welds that couple the exterior plates to the interior extension. Optionally, at least one of the first connector and the second connector is then welded to one of the first column segment or the second column segment.

In an embodiment of a column or boom connector system, the connector system includes a first column segment having a first end and a second end and at least a second column segment also having a first end and a second end. A first connector on the second end of the first column segment includes two exterior extensions, each extension having a first base, a first side perpendicular to the first base, and a second side space apart from the first side and also perpendicular to the first base. A first aperture extends through each of the exterior extensions.

The first connector of the column connector system also includes at least one interior extension, the interior extension having a second base, a first side perpendicular to the second base, and a second side spaced apart from the first side and also perpendicular to the second base. A second aperture extends through the interior extension.

The first connector also includes an interior plate disposed between and coupled to the interior extension and one of the exterior extensions. Another interior plate is disposed between and coupled to the interior extension and the other exterior extension. Each of the interior plates includes an interior plate base aligned substantially in a plane with the first base and the second base to form a first connector mounting surface. A first interior plate side is perpendicular to the interior plate base and positioned adjacent to the second side of the exterior extension. A second interior plate side also is perpendicular to the interior plate base and is spaced apart from the first interior plate side. The second interior plate side is positioned adjacent to one of the first side and the second side of the interior extension.

The column connector system also includes a second connector on the first end of the second column segment. The second connector includes at least two interior extensions.

The second connector also includes at least one interior plate disposed between and coupled to each of the two interior extensions of the second connector. The interior plate base is aligned substantially in a plane with each of the first bases of the two interior extension of the second connector to form a second connector mounting surface. The first interior plate side is positioned adjacent to the second side of one of the interior extensions of the second connector, and the second interior plate side is positioned adjacent to the first side of the other interior extension of the second connector.

The second connector of the column connector system also includes an exterior plate coupled to one of the interior extensions of the second connector, and another exterior plate coupled to the other interior extension of the second connector. Each of the exterior plates include an exterior plate base aligned substantially in a plane with the second base of each of the interior extensions of the second connector to form a second connector mounting surface, a first exterior plate side perpendicular to the exterior plate base, and a second exterior plate side perpendicular to the exterior plate base. The second exterior plate side is also spaced apart from the first exterior plate side and positioned adjacent to one of the first side and the second side of one of the interior extensions of the second connector.

A pin inserted through the first aperture of each exterior extension and the second aperture of each interior extension of the first connector and the second connector couples the first connector to the second connector.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

FIG. 6 is a top plan view of the first connector of FIG. 4*a*.

FIG. 7 is a side elevation view of the first connector of FIG. 4*a*.

FIG. 8 is a top plan view of the second connector of FIG. 5*a*.

FIG. 9 is a side elevation view of the second connector of FIG. 5*a*.

FIG. 10 is a perspective view of the first connector of FIG. 4*a* coupled to the second connector of FIG. 5*a*.

DETAILED DESCRIPTION

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

For ease of reference, designation of "top," "bottom," "horizontal" and "vertical" are used herein and in the claims to refer to portions of a sectional column or sectional boom in a position in which it would typically be assembled on or near the surface of the ground. These designations still apply although the boom may be raised to different angles, including a vertical position.

Figure 1:
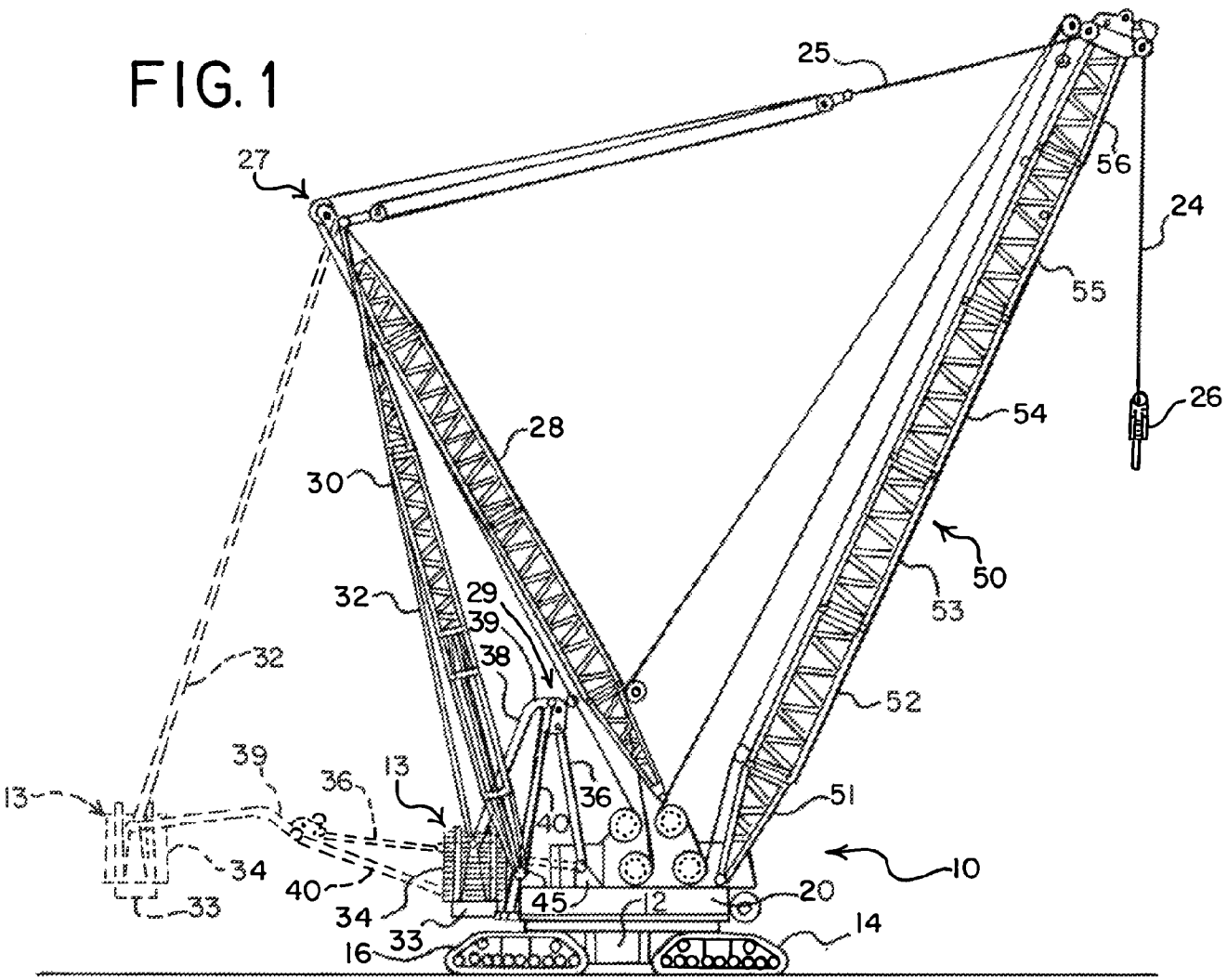
FIG. 1 is a side elevational view of a crane with a sectional boom utilizing an embodiment of a boom connector system.

The mobile lift crane 10, as shown in FIG. 1, includes lower works, also referred to as a carbody 12, and moveable ground engaging members in the form of crawlers 14 and 16. (There are of course two front crawlers 14 and two rear crawlers 16, only one each of which can be seen from the side view of FIG. 1.) In the crane 10, the ground engaging members could be just one set of crawlers, one crawler on each side. Of course additional crawlers than those shown, or other ground engaging members such as tires, can be used.

A rotating bed 20 is rotatably connected to the carbody 12 using a roller path, such that the rotating bed 20 can swing about an axis with respect to the ground engaging members 14, 16. The rotating bed supports a boom 50 pivotally mounted on a front portion of the rotating bed; a mast 28 mounted at its first end on the rotating bed; a backhitch 30 connected between the mast and a rear portion of the rotating bed; and a moveable counterweight unit 13 having counterweights 34 on a support member 33. The counterweights may be in the form of multiple stacks of individual counterweight members on the support member 33.

Boom hoist rigging 25 between the top of mast 28 and boom 50 is used to control the boom angle and transfers load so that the counterweight 34 can be used to balance a load lifted by the crane. A hoist line 24 extends from the boom 50, supporting a hook 26. The rotating bed 20 may also includes other elements commonly found on a mobile lift crane, such as an operator's cab and hoist drums for the rigging 25 and hoist line 24. If desired, the boom 50 may comprise a luffing jib pivotally mounted to the top of the main boom, or other boom configurations. The backhitch 30 is connected adjacent the top of the mast 28. The backhitch 30 may comprise a lattice member designed to carry both compression and tension loads as shown in FIG. 1. In the crane 10, the mast 28 is held at a fixed angle with respect to the rotating bed during crane operations, such as a pick, move and set operation.

The counterweight unit 13 is moveable with respect to the rest of the rotating bed 20. In the embodiment of the crane 10 depicted, the counterweight unit 13 is designed to be moved in and out with respect to the front of the crane 10 in accordance with the invention disclosed in U.S. Pat. Nos. 7,546,928 and 7,967,158, each entitled "Mobile Lift Crane With Variable Position Counterweight." A tension member 32 connected adjacent the top of the mast 28 supports the counterweight unit 13. A counterweight movement structure 29 is connected between the rotating bed 20 and the counterweight unit 13 such that the counterweight unit 13 may be moved to and held at a first position in front of or forward of a top 27 of the mast 28, as shown in solid lines in FIG. 1, and moved to and held at a second position rearward of the top 27 of the mast 28, as shown in dotted lines in FIG. 1.

In the crane 10, the counterweight movement structure 29 includes a hydraulic cylinder 36, pivot frame 40 and a rear arm 38 may be used to move the counterweight unit 13. (As with the crawlers 14 and 16, the rear arm 38 actually has both left and right members, only one of which can be seen in FIG. 1, the pivot frame 40 has two side members, and the hydraulic cylinder 36 comprises two cylinders that move in tandem. Alternatively, one larger hydraulic cylinder, or a rack and pinion structure, powered by preferably four hydraulic motors, could be used in place of the two hydraulic cylinders 36 to provide the linear actuation. Further, the pivot frame 40 could be made as a solid plate structure, and the two rear arms 38 could be replaced by one single structure.) The pivot frame 40 is connected between the rotating bed 20 and hydraulic cylinder 36, and the rear arm 38 is connected between the pivot frame 40 and the counterweight unit 13. The hydraulic cylinder 36 is pivotally connected to the rotating bed 20 on a support frame 45 which elevates the hydraulic cylinder 36 to a point so that the geometry of the cylinder 36, pivot frame 40 and rear arm 38 can move the counterweight unit 13 through its entire range of motion. In this manner the cylinder 36 causes the rear arm 38 to move the counterweight unit 13 when the cylinder 36 is retracted and extended.

Rear arms 38 have an angled portion 39 at an end that connects to the pivot frame 40. This allows the rear arms 38 to connect directly with the side members of pivot frame 40. The angled portion 39 prevents the rear arms 38 from interfering with the side members of the pivot frame 40 the when the counterweight unit 13 is in the position shown in solid lines in FIG. 1.

The boom 50 is made of several sectional members, typically referred to as boom segments or column segments. The sectional members illustrated in FIG. 1 include a boom butt 51, boom or column insert segments 52, 53, 54, and 55, which may vary in number and be of different lengths, and a boom top 56. The boom butt 51, boom or column insert segments 52, 53, 54, and 55, and the boom top 56 typically are comprised of multiple chords 61*a*, 61*b*, 63*a*, 63*b* (FIG. 2).

Figure 2:
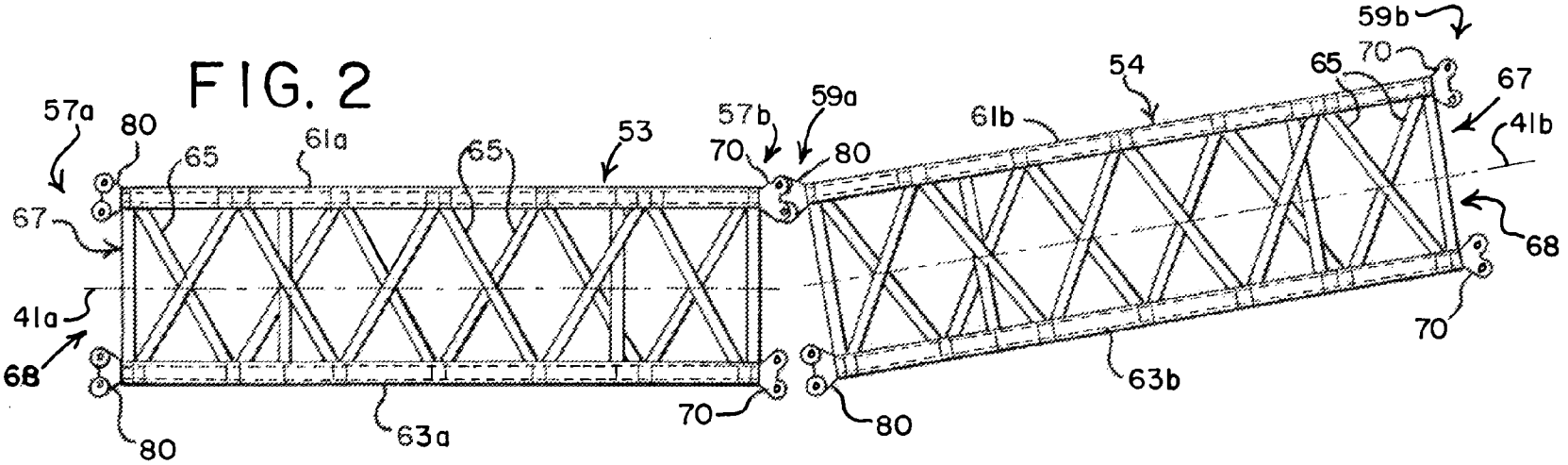
FIG. 2 is a side elevational view of two boom segments with boom or column connectors being brought together to form the boom on the crane of FIG. 1.
Figure 3:
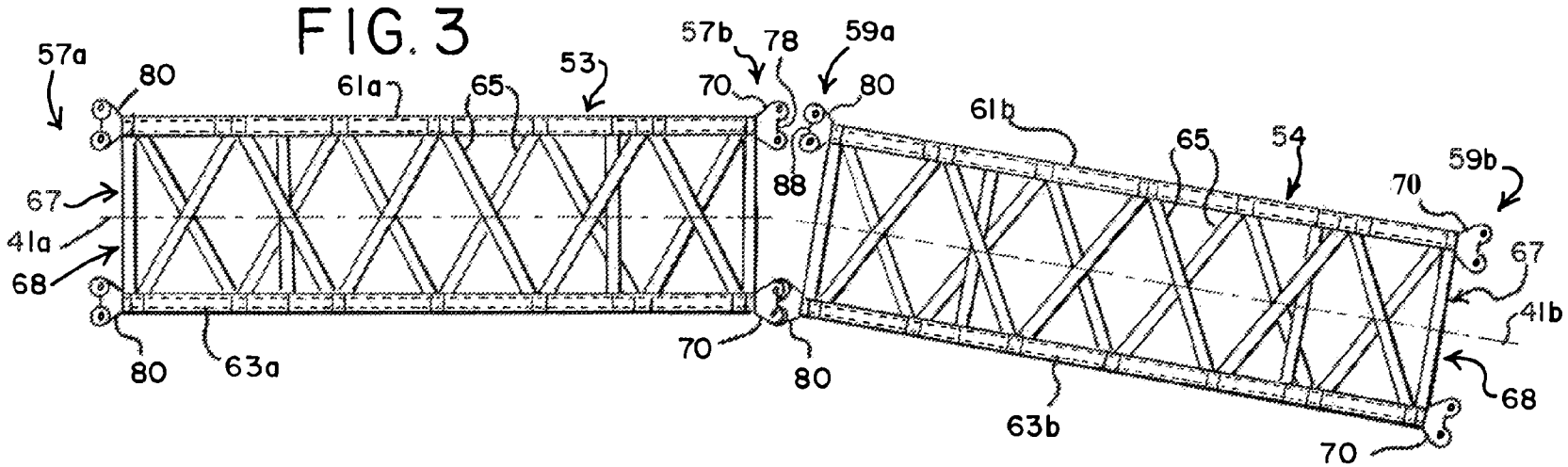
FIG. 3 is a side elevational view of the two boom segments of FIG. 2 being brought together from a second position to form the boom on the crane of FIG. 1.

As illustrated in FIGS. 2 and 3, each boom or column segment 53 and 54 has a rectangular cross section with a chord 61*a*, 63*a* and 61*b*, 63*b*, respectively, on each boom or column segment 53, 54. The boom segments 53 and 54, which are representative and may be considered as a first boom or column segment and a second boom or column segment, respectively, each have a longitudinal axis 41*a* and 41*b* (FIG. 2). The first boom segment 53 includes a first end 57*a* and a second end 57*b*. Likewise, the second boom segment 54 includes a first end 59*a* and a second end 59*b*. The second end 57*b* of the first boom segment 53 is coupled to the first end 59*a* of the second boom segment 54. There are two top chords 61*a*, 61*b* and two bottom chords 63*a*, 63*b* (only one of each of which can be seen in the side views) interconnected by intermediate lacing or lattice elements 65 connecting the chord 61*a* to chord 63*a* and chord 61*b* to chord 63*b* into a fixed, parallel relationship forming each respective boom segment 53 and 54. In the embodiment shown, the chord members 61*a*, 61*b* and 63*a*, 63*b* are made of steel with a circular, tubular cross section, although it is understood that the chord members can be formed to have a different cross-section, including oval, rectangular, angled or L-shaped, and others.

Each chord member 61*a*, 61*b*, 63*a*, 63*b* has a vertical neutral axis and a horizontal neutral axis. Compressive loads applied at the intersection of the vertical and horizontal neutral axes of a chord 61*a*, 61*b*, 63*a*, 63*b*, or symmetrically about the horizontal and vertical neutral axes, will not induce bending moments within the chord 61*a*, 61*b*, 63*a*, and 63*b*. Thus it is preferable that a connector 70, 80 used to connect boom segments 53, 54, respectively, together be mounted on the boom segments 53, 54 at the ends of the chords 61*a*, 61*b*, 63*a*, and 63*b* in such a way that compressive loads transmitted through the connectors 70, 80 are symmetrical about the neutral axes of the chords 61*a*, 61*b*, 63*a*, and 63*b*.

Thus, it can be seen that a column segment or boom segment 53 includes a plurality of chords 61*a*, 63*a* in which a lattice structure 65 couples each chord 61*a* to at least another chord 63*a*, each chord 61*a*, 63*a* having a first end 57*a* and a second end 57*b*. A first connector 70 is affixed to the second end 57*b* of a top chord 61*a* and a bottom chord 63*a* on the first column or boom segment 53. Similarly, column segment or boom segment 54 includes another plurality of chords 61*b*, 63*b* in which another lattice structure 65 couples each chord 61*b* of the another plurality of chords 61*b*, 63*b* to at least another chord 63*b*, each chord 61*b*, 63*b* having a first end 59*a* and a second end 59*b*. The second connector 80 is affixed to the first end 59*a* of a top chord 61*b* and a bottom chord 63*b* on the second column or boom segment 54. As explained below, embodiments of the first connector 70 couple with the second connector 80 to mate the first boom or column segment 53 to the second boom or column segment 54.

As shown in FIG. 2, either the connectors 70, 80 on the top chords 61*a*, 61*b* can be connected first, or, as shown in FIG. 3, the connectors 70, 80 on the bottom chords 63*a*, 63*b* can be connected first, while the boom segments are in a non-aligned configuration. The boom segments can then be pivoted and will automatically stop in a position where the additional connectors are aligned. It is also possible that the boom segments can be brought together with the longitudinal axes of the segments already lined up.

While the discussion generally refers to the boom 50 and its boom or column segments and how they are coupled with embodiments of the first connector 70 and the second connector 80, it is noted that these connectors may also connect the various boom and/or column segments in the mast 28, the backhitch 30, and elsewhere that boom or column segments are to be coupled together.

FIGS. 4*a*, 5*a* and 6-10 illustrate embodiments of the first connector 70 and a second connector 80. As best seen in the exploded view of FIG. 4*a*, top view of FIG. 6, and side view of FIG. 7, the first connector 70 includes n extensions 71, 72, 73, where n is a positive integer, e.g., 1, 2, 3, and so on. Consequently, n, in this illustrated embodiment, is the positive integer 3. Each extension 71, 72, 73 has a first base 71*a*, 72*a*, and 73*a*, as best seen in the top view in FIG. 6.

Each extension 71, 72, 73 also includes a first side 71*b*, 72*b*, 73*b* extending away from the first base 71*a*, 72*a*, 73*a* and a second side 71*c*, 72*c*, 73*c*, also extending away from the first base 71*a*, 72*a*, 73*a* and spaced apart from each respective first side 71*b*, 72*b*, 73*b*. It is understood that while specific reference is made to a first side (e.g., 71*b*, 72*b*, 73*b*) and a second side (e.g., 71*c*, 72*c*, 73*c*), one of skill in the art would understand that the references to the first side and the second side are interchangeable. That is, what is referred to as the first side could just as easily be referred to as the second side and vice-versa. Thus, while throughout this application references to the various embodiments in the specification and the figures will be to a specific side, such as a first side and second side, it is understood that the formulation could be reversed.

Optionally, at least one of the first side 71*b*, 72*b*, 73*b* and the second side 71*c*, 72*c*, 73*c* of the extensions 71, 72, 73 is perpendicular to its respective first base 71*a*, 72*a*, and 73*a*. In the event n is an odd integer greater than or equal to 1, the connector 70 includes one or more interior extensions. In the embodiment illustrated in FIG. 4*a*, the extension 72 is an interior extension and includes a first distance 72*e* between the first side 72*b* and the second side 72*c*. Likewise, in the event that n is an integer greater than or equal to 2, the connector optionally includes at least two exterior extensions, such as extensions 71 and 73, each having a second distance 71*e*, 73*e* between the first side 71*b*, 73*b* and the second side 71*c*, 73*c*, that is less than the first distance 72*e*. Thus, as can be seen in the embodiment illustrated in FIGS. 4*a* and 6, because n equals 3, the connector 70 includes the interior extension 72 and two exterior extensions 71, 73.

Each extension 71, 72, 73 also includes at least one first aperture 71*d*, 72*d*, 73*d*—two apertures are illustrated in each extension in the figures—that extends through each extension 71, 72, 73 from the first side 71*b*, 72*b*, 73*b* to the second side 71*c*, 72*c*, 73*c*.

Preferably the extensions 71, 72, 73 are formed of metal. Typically, the metal is of any known type of steel, but other metals may be selected to form the extensions. In some embodiments, at least one extension 71, 72, 73 is formed of steel having a grain structure elongated in a direction of rolling that is substantially perpendicular to the first base 71*a*, 72*a*, 73*a*.

The first connector 70 also includes at least (n+y) plates 74, 75 where y is selected from the group consisting of (−1, +1) such that the sum of (n+y) is a positive integer. As previously noted, because n equals 3 in FIG. 4*a* and two plates 74, 75 are illustrated, y consequently must be −1 (3 extensions−1=2 plates). Alternatively, and as illustrated in FIG. 4*b*, in the event y is +1 the connector 70' would appear with the same elements noted with a prime notation. Thus, this embodiment in FIG. 4*b* includes three extensions, 71', 72', 73', and four plates 74', 75', 76', and 77' (3 extensions+1=4 plates). Reference will generally be made to the embodiment disclosed in FIG. 4*a*, but each of the elements and features identified in FIG. 4*a* are present in the embodiment in FIG. 4*b*.

Figures 4A, 5A:
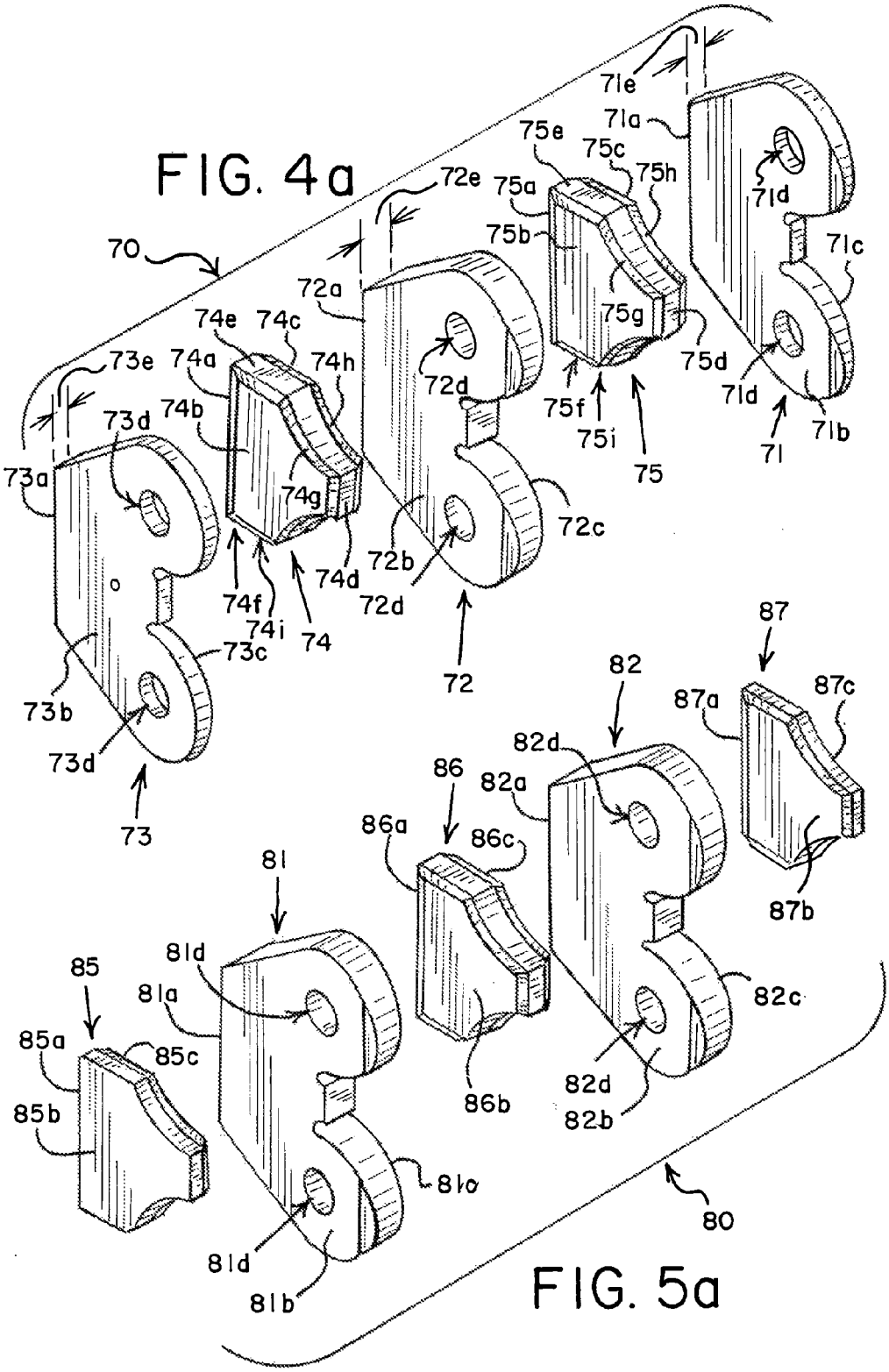
FIG. 4*a* is an exploded perspective view of a first connector of a first embodiment of a column connector system.
FIG. 5*a* is an exploded perspective view of a second connector of the first embodiment of a column connector system.
Figure 4B:
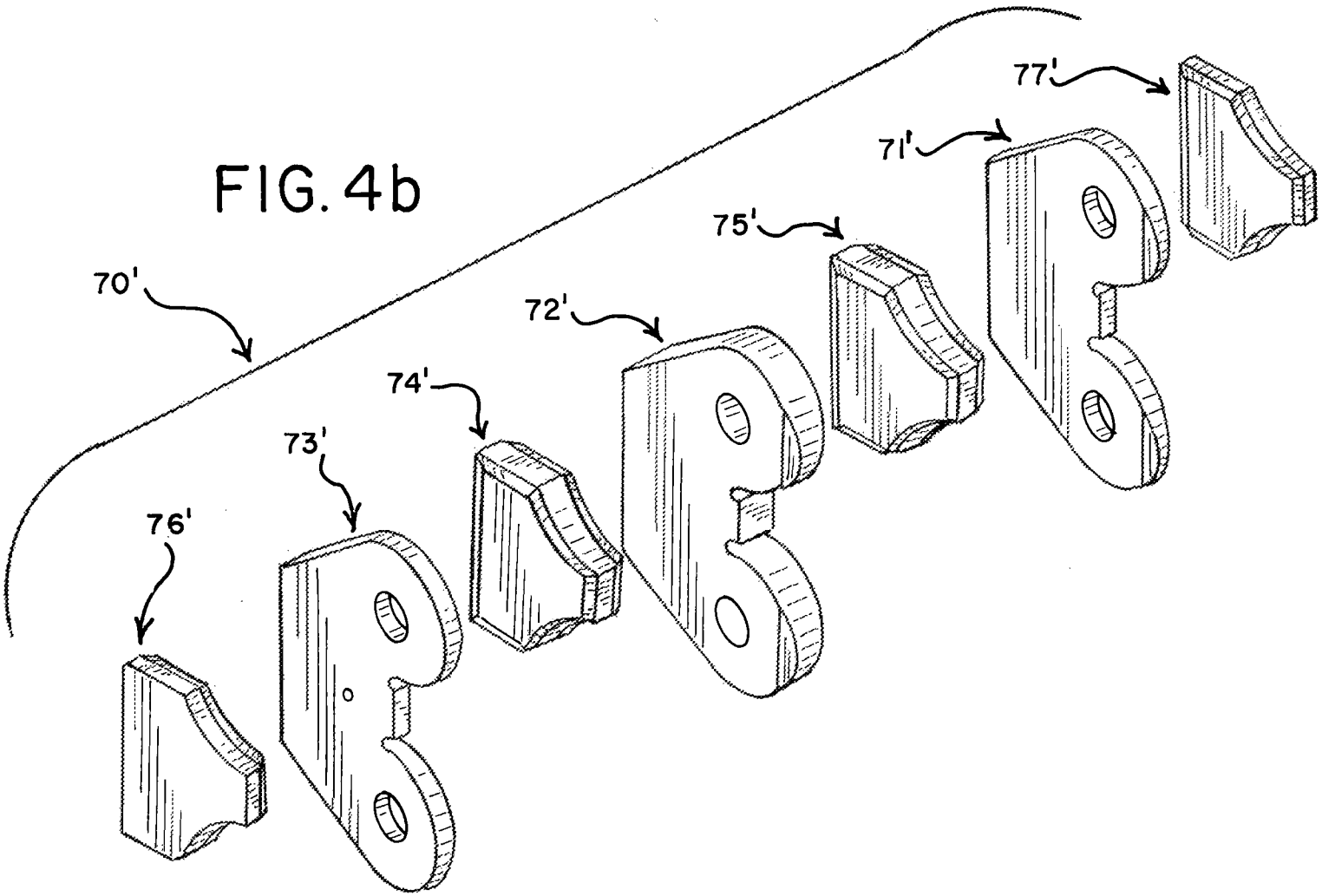
FIG. 4*b* is an exploded perspective view of a first connector of a second embodiment of a column connector system.

The plates 74, 75 are positioned in and coupled to the extensions 71, 72, 73 in an alternating arrangement as seen in FIGS. 4*a* and 6. Each plate 74, 75 includes a plate base 74*a*, 75*a* substantially aligned in a plane with the first base 71*a*, 72*a*, 73*a* of the extensions 71, 72, 73 to form a first connector mounting surface 78 (FIGS. 6 and 7). Aligned, or substantially aligned in a plane refers to the engineering tolerances to which the first connector mounting surface 78, and others, are formed and assembled. Each plate 74, 75 also includes a first plate side 74*b*, 75*b*, extending away from the plate base 74*a*, 75*a*, the first plate side 74*b*, 75*b* being positioned adjacent to one of the first side 71*b*, 72*b*, 73*b* and the second side 71*c*, 72*c*, 73*c* of at least one of the extensions 71, 72, 73. Thus, as illustrated, the first plate side 74*b* of plate 74 is adjacent to the second side 73*c* of the extension 73. Similarly, the first plate side 75*b* of plate 75 is positioned adjacent second side 72*c*. Each plate 74, 75 also includes a second plate side 74*c*, 75*c* extending away from the plate base 74*a*, 75*a*, the second plate side 74*c*, 75*c* being spaced apart from the first plate side 74*b*, 75*b*.

Optionally, one or more of the plates 74, 75 includes a plate surface 74*d*, 75*d* spaced laterally apart from the plate base 74*a*, 75*a*, respectively, a plate top 74*e*, 75*e* extending away from the plate base 74*a*, 75*a* that intersects the first plate side 74*b*, 75*b* and the second plate side 74*c*, 75*c*. In addition, the plates 74, 75 optionally include a plate bottom 74*f*, 75*f* spaced apart from the plate top 74*e*, 75*e*, while also extending away from the plate base 74*a*, 75*a* and intersecting the first plate side 74*b*, 75*b* and the second plate side 74*c*, 75*c*. Embodiments of such a plate 74, 75 include, but are not limited to, plates having the shape of a square, rectangle, parallelogram, trapezoid, and other such shapes.

Optionally, the plates 74, 75 further include a first surface 74*g*, 75*g* that extends away from the plate base 74*a*, 75*a*, the plate surface 74*d*, 75*d*, the plate top 74*e*, 75*e*, and the plate bottom 74*f*, 75*f* until the first surface 74*f*, 75*f* meets the first plate side 74*b*, 75*b*. In addition, or alternatively, the plates 74, 75 further include a second surface 74*h*, 75*h* that extends away from the plate base 74*a*, 75*a*, the plate surface 74*d*, 75*d*, the plate top 74*e*, 75*e*, and the plate bottom 74*f*, 75*f* until the second surface 74*h*, 75*h* meets the second plate side 74*c*, 75*c*. The first surface 74*g*, 75*g* and the second surface 74*h*, 75*h* can be, for example, a recess, a groove, such as a stress relief groove, chamfer, fillet, and other similar shapes. A purpose of the first surface 74*g*, 75*g* and the second surface 74*h*, 75*h* is that the surface provides additional space to permit a weld of adequate thickness and strength to be positioned between the plates 74, 75 and the extensions 71, 72, and 73 as discussed below.

In some embodiments, the plates 74, 75 are coupled or joined to the extensions 71, 72, 73 with welds 100 as illustrated in FIG. 6. Welds 100 are located at least partly along a periphery or perimeter 74*i*, 75*i* of each plate 74, 75 and, more preferably, the welds 100 are located around substantially the entire periphery or perimeter 74*i*, 75*i* of each plate 74, 75. The welds 100 may be formed by any welding process known in the art, including TIG welding, MIG welding, laser welding, and other known welding processes. The welds 100 may be formed as a continuous weld or they may be multiple welds formed in one or more welding steps.

The first connector mounting surface 78 is coupled or joined to the first column segment 53, typically at an end of the chord 61*a*, 63*a*. The first connector mounting surface 78 can be joined to the first column segment 53 in any manner known in the art, including welding, bolting, and other methods. To assist in coupling the first connector mounting surface 78 to the first column segment 53, the first column connecting surface optionally includes at least one hole or recess 79, illustrated in FIG. 6, configured to align the first connector 70 to the first column segment 53. While the hole 79 is illustrated in the first base 72*a* of the extension 72, it optionally can be located elsewhere on the first connector mounting surface 78 (e.g., on any of the first base 71*a*, 72*a*, 73*a* and the plate base 74*a*, 75*a*).

As previously noted and illustrated in FIGS. 2 and 3, the connector 70 couples with a connector 80 so as to join the column segment 53 with the column segment 54. As best seen in the exploded view of FIG. 5*a*, top view of FIG. 8, and side view of FIG. 9, the second connector 80 includes (n+y) extensions 81 and 82 similar to the extensions 71, 72, 73 and with (n+y) defined above. As previously noted, because n equals 3 and y is −1, consequently and as illustrated in FIGS. 5*a* and 8 there must be two (2) extensions 81, 82. Alternatively, and in the embodiment illustrated in FIG. 5*b*, in the event y is +1 the connector 80' would appear with the same elements noted with a prime notation. Consequently, (n+y) would be the positive integer 4 and the embodiment in FIG. 5*b* includes four (4) extensions, 81', 82', 83', and 84'. Reference will generally be made to the embodiment disclosed in FIG. 5*a*, but each of the elements and features identified in FIG. 5*a* are present in the embodiment in FIG. 5*b*.

Turning back to FIG. 5*a*, each extension 81, 82 includes a second base 81*a*, 82*a*, as best seen in the top view in FIG. 8. Each extension 81, 82 also includes a first side 81*b*, 82*b* extending away from the second base 81*a*, 82*a* and a second side 81*c*, 82*c* also extending away from the second base 81*a*, 82*a* and spaced apart from each respective first side 81*b*, 82*b*.

Each extension 81, 82 also includes at least one second aperture 81*d*, 82*d*—two apertures are illustrated in the extensions in the figures—that extends through each extension 81, 22 from the first side 81*b*, 82*b* to the second side 81*c*, 82*c*.

Figure 5B:
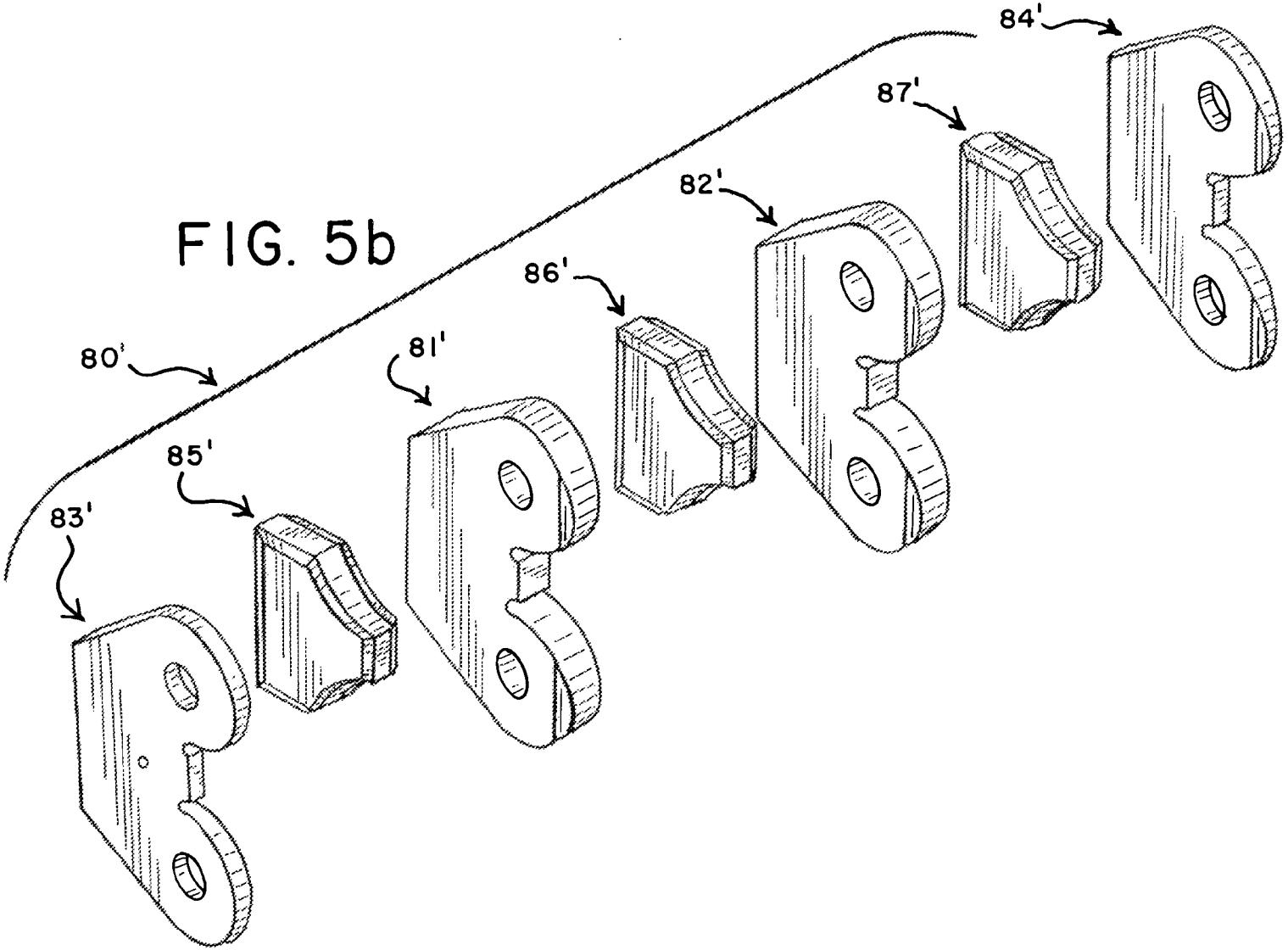
FIG. 5*b* is an exploded perspective view of a second connector of the second embodiment of a column connector system.

The second connector 80 also includes at least n plates 85, 86, 87 (and 85', 86', 87' in FIG. 5*b*). The plates 85, 86, 87 are positioned in and coupled to the extensions 81, 82 in an alternating arrangement as seen in FIGS. 5*a* and 8. Each plate 85, 86, 87 includes a plate base 85*a*, 86*a*, 87*a* substantially aligned in a plane with the second base 81*a*, 82*a* of the extensions 81, 82 to form a second connector mounting surface 88. Each plate 85, 86, 87 also includes a first plate side 85*b*, 86*b*, 87*b* extending away from the plate base 85*a*, 86*a*, 87*a*, the first plate side 85*b*, 86*b*, 87*b* being positioned adjacent to one of the first side 81*b*, 82*b* and the second side 81*c*, 82*c* of at least one of the extensions 81, 82. Thus, as illustrated, the first plate side 86*b* of plate 86 is adjacent to the second side 81*c* of the extension 81. Similarly, the first plate side 87*b* of plate 87 is positioned adjacent to the second side 82*c* of extension 82. Each plate 85, 86, 87 also includes a second plate side 85*c*, 86*c*, 87*c* extending away from the plate base 85*a*, 86*a*, 87*a*, the second plate side 85*c*, 86*c*, 87*c* being spaced apart from the first plate side 85*b*, 86*b*, 87*b*. Embodiments of such a plate 85, 86, 87 include, but are not limited to, plates having the shape of a square, rectangle, parallelogram, trapezoid, and other such shapes. Optionally, the second connector 80 can be cast as a unitary structure.

It is noted that in some embodiments the extensions 71, 72, 73 are substantially identical in shape and/or dimension to the extensions 81, 82, while in other embodiments the shape and the dimensions may differ. Likewise, in some embodiments the plates 74, 75 are substantially identical in shape and/or dimension to the plates 85, 86, 87 while in other embodiments the shape and/or the dimensions may differ.

A pin 90, as best seen in FIG. 10, is inserted through the first aperture 71*d*, 72*d*, 73*d* of each extension 71, 72, 73 of the first connector 70 and the second aperture 81*d*, 82*d* of each extension 81, 82 of the second connector 80. The pin 90 couples the first connector 70 to the second connector 80 and, consequently, the first column or boom segment 53 to the second column or boom segment 54.

An embodiment of a column or boom connector system 110, indicated in FIGS. 2 and 3, includes the first column or boom segment 53 having the first end 57*a* and the second end 57*b*. The boom connector system 110 also includes at least the second column or boom segment 54 having a first end 59*a* and a second end 59*b*.

As it relates to the boom or column connector system 110, another manner in which to consider the first connector 70 and the second connector 80 are now described. Referring to FIGS. 4*a*, 6, and 7, a first connector 70 on the second end 57*b* of the first column or boom segment 53 includes at least two extensions and, in the embodiment illustrated, three extensions 71, 72, and 73. In the embodiment illustrated, the extensions 71 and 73 are exterior extensions and extension 72 is an interior extension. In this example, n equals 3.

An interior plate 74 is coupled to at least one exterior extension 71, 73 (extension 73 in the embodiment illustrated) and the interior extension 72. The first interior plate side 74*b* is positioned adjacent to the second side 73*c* of the exterior extension 73. The second interior plate side 74*c* is positioned adjacent to the first side 72*b* of the interior extension 72.

A second or another interior plate 75 is coupled to at least one exterior extension 71, 73 (extension 71 in the embodiment illustrated) and the interior extension 72. The another first interior plate side 75*b* is positioned adjacent to the second side 72*c* of the interior extension 72. The another interior plate 75 also has another second interior plate side 75*c* perpendicular to the interior plate base 75*a*, which is spaced apart from the another first interior plate side 75*b*. The another second interior plate side 75*c* is positioned adjacent to the first side 71*b* of the exterior extension 71.

The column or boom connector system 110 also includes a second connector 80 on the first end 59*a* of the second column or boom segment 54, as seen in FIGS. 2 and 3. The second connector 80 includes at least one interior extension 81 and, as illustrated in FIG. 5*a*, optionally includes at least another or a second interior extension 82. The at least one interior extension 81 and at least another extension 82 each include a second base 81*a*, 82*a*, a first side 81*b*, 82*b* perpendicular to the second base 81*a*, 82*a*, and a second side 81*c*, 82*c* also perpendicular to the second base 81*a*, 82*a* and spaced apart from the first side 81*b*, 82*b*. A second aperture 81*d*, 82*d* extends through the interior extension 81, 82 as illustrated in FIGS. 5*a*, 8, and 9.

As illustrated in FIG. 5*a*, a first exterior plate 85 is coupled to the at least one interior extension 81 and a second exterior plate 87 is coupled to the at least another interior extension/second interior extension 82. Each of the first exterior plate 85 and the second exterior plate 87 has an exterior plate base 85*a*, 87*a* aligned substantially in a plane with the second base 81*a*, 82*a* of the at least one interior extension 81 to form a second connecting mounting surface 88 of the second connector 80.

Each exterior plate 85, 87 also includes a first exterior plate side 85*b*, 87*b* perpendicular to the exterior base plate 85*a*, 87*a* and a second exterior plate side 85*c*, 87*c* also perpendicular to the exterior base plate 85*a*, 87*a* and spaced apart from the first exterior plate side 85*b*, 87*b*. The second exterior plate side 85*c* of the first exterior plate 85 is positioned adjacent the first side 81*b* of the at least one interior extension 81 of the second connector 80.

Optionally, one or more of the exterior plates 85, 87 include an exterior plate surface 85*d*, 87*d* spaced laterally apart from the exterior plate base 85*a*, 87*a*. An exterior plate top 85*e*, 87*e* extends away from the exterior plate base 85*a*, 87*a* and intersects the first exterior plate side 85*b*, 87*b* and the second exterior plate side 85*c*, 87*c*. An exterior plate bottom 85*f*, 87*f* is spaced apart from the exterior plate top 85*e*, 87*e* and also extends away from the exterior plate base 85*a*, 87*a*. The exterior plate bottom 85*f*, 87*f* also intersects the first exterior plate side 85*b*, 87*b* and the second exterior plate side 85*c*, 87*c*. In some embodiments, a first surface 85*g*, 87*g* extends away from the exterior plate base 85*a*, 87*a*, the exterior plate surface 85*d*, 87*d*, the exterior plate top 85*e*, 87*e*, and the exterior plate bottom 85*f*, 87*f* until the first surface 85*g*, 87*g* of the exterior plate 85, 87 meets one of the first exterior plates side 85*b*, 87*b* and the second exterior plate side 85*b*, 87*b*.

In addition and as illustrated in FIG. 5*a*, the embodiment of the second connector 80 also optionally includes at least one interior plate 86 disposed between and coupled to the interior extension 81 and the another interior extension 82. The interior plate 86 includes an interior plate base 86*a* aligned substantially in a plane with each of the second bases 81*a*, 82*a* of the interior extensions 81, 82 and the exterior plate bases 85*a*, 87*a*. In addition, a first interior plate side 86*b* of the interior plate 86 is positioned adjacent to the second side 81*c*, 82*c* of one of the interior extensions 81, 82, and a second interior plate side 86*c* of the interior plate 86 is positioned adjacent to the first side 81*b*, 82*b* of the other interior extension 81, 82.

In some embodiments, the first connector 70 optionally includes a plurality of welds 100 (FIG. 6) that couple the interior plate or plates of the connector 70 to one or more of the extensions. Likewise, the connector 80 optionally includes a plurality of welds 101 that couple the interior plate or plates of the connector 80 to one or more of the extensions. For example and as illustrated in FIGS. 4*a* and 6, connector 70 includes a plurality of welds 100 that couple the interior plates 74 and 75 to one or more of the extensions 71, 72, and 73. As illustrated, a weld(s) 100 optionally follow a periphery 74*i* to couple the interior plate 74 to at least to the exterior extension 73 and, optionally, to the interior extension 72. A weld(s) 100 optionally follow a periphery 75*i* to couple the interior plate 75 to at least to the interior extension 72 and, optionally, to the exterior extension 71. Similarly and as illustrated in FIGS. 5*a* and 8, connector 80 includes a plurality of welds 101 that couple the exterior plates 85, 87 to one or more of the interior extensions 81, 82, and, optionally, the interior plate 86 to one or more of the interior extensions 81, 82. As illustrated, a weld(s) 101 optionally follow a periphery 85*i* to couple the exterior plate 85 to at least the interior extension 81, and a weld(s) 101 optionally follow a periphery 87*i* to couple the exterior plate 87 to at least the interior extension 82.

Optionally, and as previously noted, at least a part of the first connector mounting surface 78 is welded to the first column or boom segment 53. Likewise, at least a part of the second connector mounting surface 88 optionally is welded to the second column or boom segment 54. Just as the first connector mounting surface 78 may include at least one hole 79 (FIG. 6) to assist in aligning and coupling the first connector mounting surface 78 to the first column or boom segment 53, the second connector mounting surface 88 may include a similar hole 89 (FIG. 8) to assist in aligning and coupling the second connector mounting surface 88 to the second column or boom segment 54. While the holes 79, 89 are illustrated in the second base 72*a* and the plate base 86*a*, respectively, it will be understood that the hole 79 and the hole 89 can be located at any desired location in the first connector mounting surface 78 and the second connector mounting surface 88, respectively.

As previously noted, at least one of the exterior extensions 71, 73 and the interior extension 72 is formed of steel having a grain structure elongated in a direction of rolling that is substantially perpendicular to at least one of the first base 71*a*, 71*a*, 73*a*. Similarly, at least one of the interior extensions 81, 82 of the second connector 80 optionally is formed of steel having a grain structure elongated in a direction of rolling that is substantially perpendicular to at least one of the second base 81*a*, 82*a*, respectively.

Figure 11:
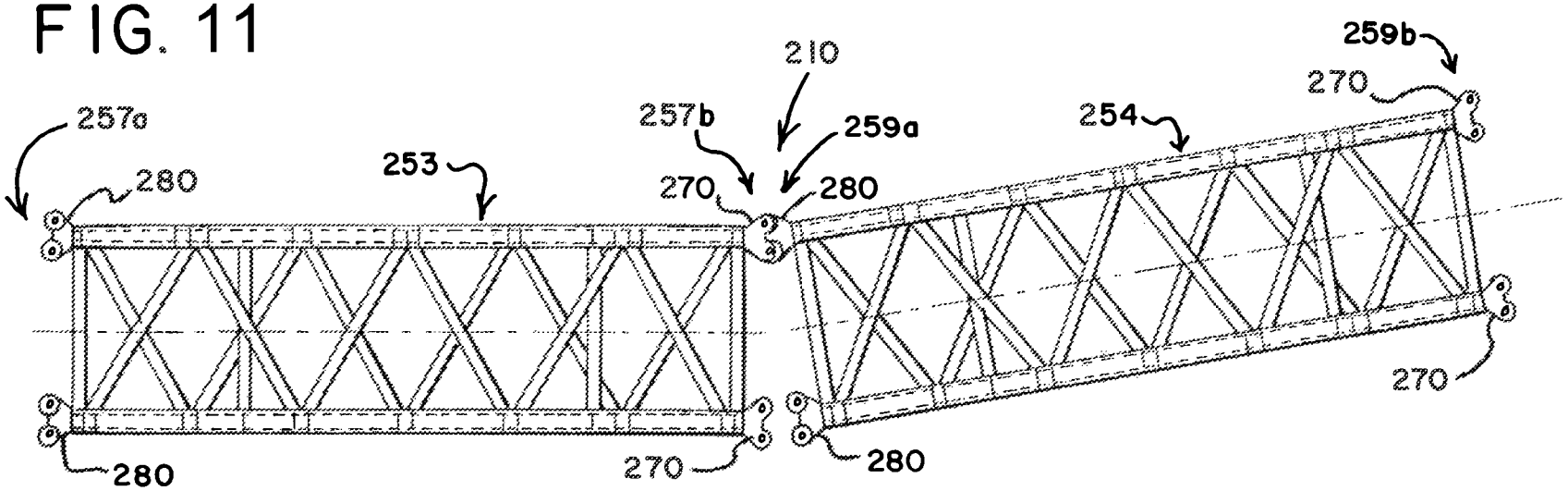
FIG. 11 is a side elevation view of another embodiment of two boom segments with column connectors being brought together to form the boom on the crane of FIG. 1.
Figure 12:
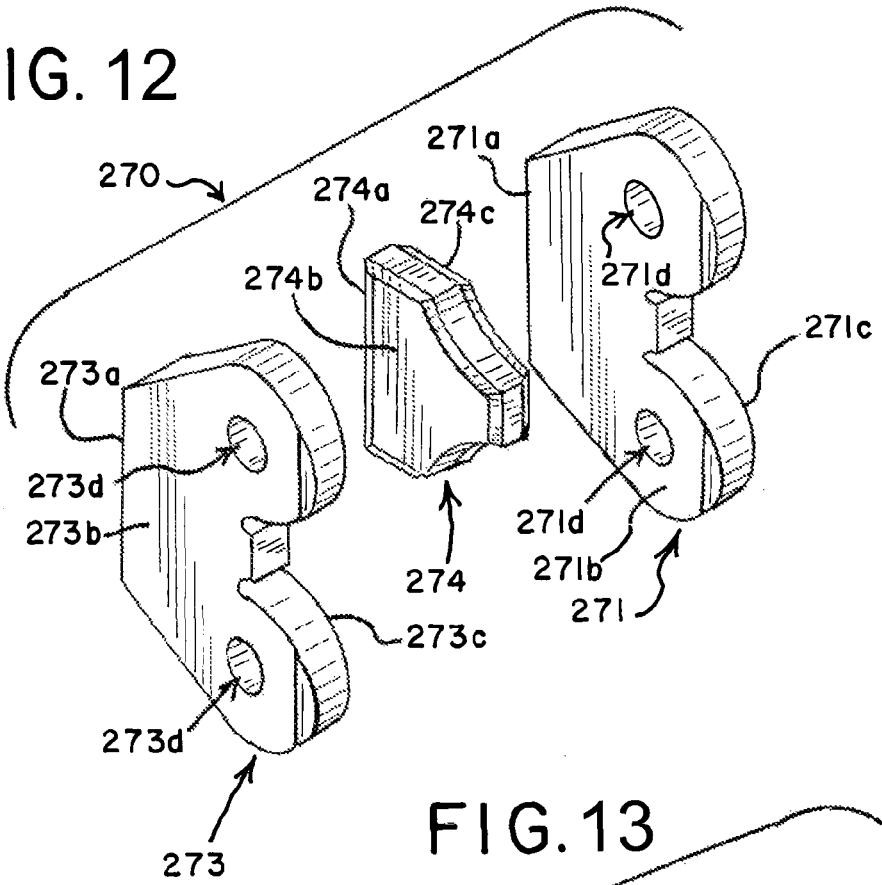
FIG. 12 is an exploded perspective view of a first connector used in a third embodiment of a column connector system used in the column segment of FIG. 11.
Figure 13:
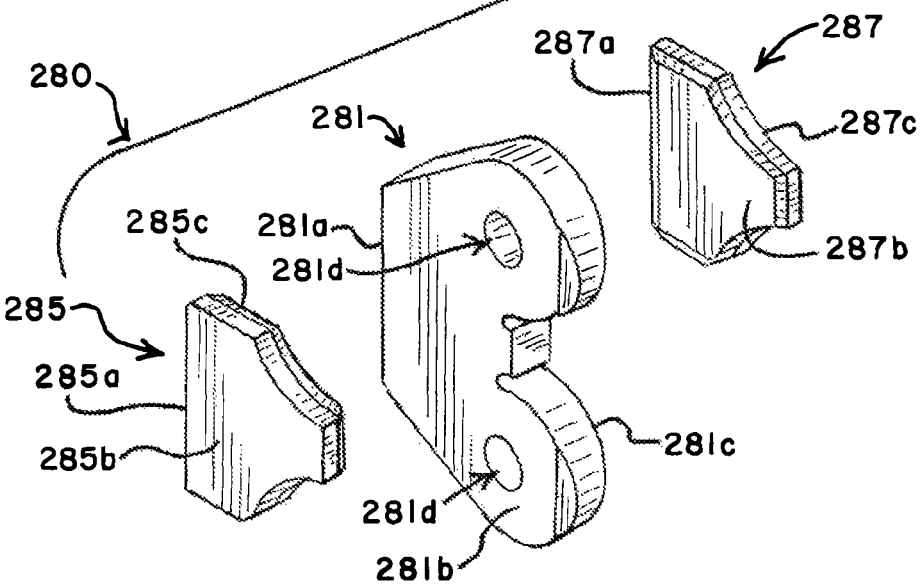
FIG. 13 is an exploded perspective view of a second connector used in the third embodiment of a column connector system used in the column segment of FIG. 11.

Referring now to FIGS. 11-13, another embodiment of a column or boom connector system 210 is disclosed in which the connector system 210 includes a first column or boom segment 253 having a first end 257*a* and a second end 257*b* and at least a second column or boom segment 254 also having a first end 259*a* and a second end 259*b*, as illustrated in FIG. 11.

In FIG. 12, a first connector 270 on the second end 257*b* of the first column or boom segment 253 includes at least two exterior extensions 271, 273, with each exterior extension 271, 273 having a first base 271*a*, 273*a*, a first side 271*b*, 271*b* perpendicular to the first base 271*a*, 273*a*, and a second side 271*c*, 273*c* spaced apart from the first side 271*b*, 273*b* and also perpendicular to the first base 271*a*, 273*a*. A first aperture 271*d*, 273*d* extends through each of the exterior extensions 271*b*, 273. In this embodiment, n equals 2. In addition, the exterior extensions 271, 273 optionally include all of the various features and elements ascribed to exterior extensions 71, 73 described above and illustrated in FIGS. 4*a*, 6, and 7.

The first connector 270 also includes at least one interior plate 274 coupled to at least one of the exterior extensions 271, 273. Here, (n+y) equals 1 plate as y equals −1. The interior plate 274 includes an interior plate base 274*a* aligned substantially in a plane with the first base 271*a*, 273*a* to form a first connector mounting surface, similar to the first connector mounting surface 78 illustrated in FIGS. 6 and 7. A first interior plate side 274*b* is perpendicular to the interior plate base 274*a* and positioned adjacent to one of the first side 271*b*, 273*b* and the second side 271*c*, 273*c* of one of the exterior extensions 271, 273. A second interior plate side 274*c* also is perpendicular to the interior plate base 274*a* and is spaced apart from the first interior plate side 274*b*. The second interior plate side 274*c* is positioned adjacent to the other of the first side 271*b*, 273*b* and the second side 271*c*, 273*c* of the other exterior extension 271, 273 of the first connector 270. The interior plate 274 optionally includes all of the various features and elements ascribed to interior plate 74 described above and illustrated in FIGS. 4*a*, 6, and 7.

The column or boom connector system 210 also includes a second connector 280 on the first end 259*a* of the second column or boom segment 254, as seen in FIG. 11. The second connector 280 includes at least one interior extension 281 having a second base 281*a*, a first side 281*b* perpendicular to the second base 281*a*, a second side 281*c* also perpendicular to the second base 281*a* and spaced apart from the first side 281*b*, and a second aperture 281*d* through the interior extension 281, as illustrated in FIG. 13. In addition, the interior extension 281 optionally includes all of the various features and elements ascribed to interior extension 81 described above and illustrated in FIGS. 5*a*, 8, and 9.

The second connector 280 also includes a first exterior plate 285 and a second exterior plate 287 (n equals 2 in the embodiments illustrated in FIGS. 11-13, as noted above), at least one of the first exterior plate 285 and the second exterior plate 287 being coupled to the at least one interior extension 281. Each of the first exterior plate 285 and the second exterior plate 287 has an exterior plate base 285*a*, 287*a* aligned substantially in a plane with the second base 281*a* of the at least one interior extension 281 to form a second connecting mounting surface, similar to the first connector mounting surface 88 illustrated in FIGS. 8 and 9.

Each exterior plate 285, 287 also includes a first exterior plate side 285*b*, 287*b* perpendicular to the exterior base plate 285*a*, 287*a* and a second exterior plate side 285*c*, 287*c* also perpendicular to the exterior base plate 285*a*, 287*a* and spaced apart from the first exterior plate side 285*b*, 287*b*. The second exterior plate side 285*c* of the first exterior plate 285 is positioned adjacent the first side 281*b* of the at least one interior extension 281 of the second connector 280 and the first exterior plate side 287*b* of the second exterior plate 287 is positioned adjacent the second side 281*c* of the at least one interior extension 281 of the second connector 280. The exterior plates 285, 287 optionally include all of the various features and elements ascribed to exterior plates 85, 87 described above and illustrated in FIGS. 5*a*, 8, and 9.

A pin (not illustrated), similar to pin 90 illustrated in FIG. 10, is inserted through the first aperture 271*d*, 273*d* of each exterior extension 271, 273 and the second aperture 281*d* of each interior extension 281 of the first connector 270 and the second connector 280, respectively, and couples the first connector 270 to the second connector 280.

The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A column segment of a column of a crane, the column having multiple segments coupled together with a column connector system, the crane having an upper works rotatably mounted on a lower works, the upper works including a load hoist winch, the column segment comprising:

a) a plurality of chords in which a lattice structure couples each chord to at least another chord, each chord having a first end and a second end;

b) a first connector on the second end of at least one of the chords, the first connector including:

n extensions, where n is a positive integer, each extension having:

a first base;

a first side extending away from the first base;

a second side extending away from the first base, the second side being spaced apart from the first side; and;

a first aperture extending through the extension from the first side to the second side;

wherein at least one extension is formed of steel having a grain structure elongated in a direction of rolling that is substantially perpendicular to the first base;

at least (n+y) plates, where y is selected from the group consisting of (−1, +1) such that the sum of (n+y) is a positive integer, the plates positioned in and coupled to the extensions in an alternating arrangement, the plates having:

a plate base aligned substantially in a plane with the first base to form a first connector mounting surface;

a first plate side extending away from the plate base, the first plate side being positioned adjacent to one of the first side and the second side of one of the extensions; and, a second plate side extending away from the plate base, the second plate side being spaced apart from the first plate side.

2. The column segment of claim 1, wherein the extensions comprise at least one interior extension when n is an odd integer greater than or equal to 1, the interior extension having a first distance between the first side and the second side, and at least two exterior extensions when n is an integer greater than or equal to 2, the exterior extensions each having a second distance between the first side and the second side that is less than the first distance.

3. The column segment of claim 1, wherein the column segment further comprises a plurality of welds that couple the plates to the extensions.

4. The column segment of claim 1, wherein at least a part of the first connector mounting surface is welded to the first column segment.

5. The column segment of claim 1, wherein the first connector mounting surface includes at least one hole configured to align the first connector to the first column segment.

6. The column segment of claim 1, wherein at least one of the plates further comprises:

a plate surface spaced laterally apart from the plate base;

a plate top extending away from the plate base, the plate top intersecting the first plate side and the second plate side;

a plate bottom extending away from the plate base, the plate bottom intersecting the first plate side and the second plate side, the plate bottom being spaced apart from the plate top;

a first surface that extends away from the plate base, the plate surface, the plate top, and the plate bottom until the first surface meets the first plate side; and, a second surface that extends away from the plate base, the plate surface, the plate top, and the plate bottom until the second surface meets the second plate side.

7. A combination of the column segment of claim 1 coupled to another column segment, the another column segment comprising:

a) another plurality of chords in which another lattice structure couples each chord of the another plurality to at least another chord of the another plurality, each chord of the another plurality having a first end and a second end;

b) a second connector on the first end of at least one of the chords of the another plurality, the second connector including:

(n+y) extensions, each extension having:

a second base;

a first side extending away from the second base;

a second side extending away from the second base, the second side being spaced apart from the first side; and;

a second aperture extending through the extension from the first side to the second side;

at least n plates, the plates positioned in and coupled to the extensions in an alternating arrangement, the plates having:

a plate base aligned substantially in a plane with the second base to form a second connector mounting surface;

a first plate side extending away from the plate base, the first plate side being positioned adjacent to one of the first side and the second side of one of the extensions of the second connector; and, a second plate side extending away from the plate base, the second plate side being spaced apart from the first plate side; and, c) a pin inserted through the first aperture of each extension of the first connector and the second aperture of each extension of the second connector, the pin coupling the first connector to the second connector.

8. The combination of claim 7, wherein the second connector is cast as a unitary structure.

9. A column connector system for a crane having a column with multiple segments coupled together with the column connector system, the crane having an upper works rotatably mounted on a lower works, the upper works including a load hoist winch, the column connector system comprising:

a) a first column segment having a first end and a second end;

b) at least a second column segment having a first end and a second end;

c) a first connector on the second end of the first column segment, the first connector including:

at least two exterior extensions, each exterior extension having:

a first base;

a first side perpendicular to the first base;

a second side perpendicular to the first base, the second side being spaced apart from the first side; and, a first aperture through the exterior extension;

at least one interior plate coupled to at least one of the exterior extensions, the interior plate having:

an interior plate base aligned substantially in a plane with the first base to form a first connector mounting surface;

a first interior plate side perpendicular to the interior plate base, the first interior plate side being positioned adjacent to one of the first side and the second side of one of the exterior extensions; and, a second interior plate side perpendicular to the interior plate base, the second interior plate side being spaced apart from the first interior plate side;

d) a second connector on the first end of the second column segment, the second connector including:

at least one interior extension having:

a second base;

a first side perpendicular to the second base;

a second side perpendicular to the second base, the second side being spaced apart from the first side; and, a second aperture through the interior extension a first exterior plate and a second exterior plate, at least one of the first exterior plate and the second exterior plate being coupled to the at least one interior extension, each of the exterior plates having:

an exterior plate base aligned substantially in a plane with the second base of the at least one interior extension of the second connector to form a second connector mounting surface;

a first exterior plate side perpendicular to the exterior plate base;

a second exterior plate side perpendicular to the exterior plate base, the second exterior plate side being spaced apart from the first exterior plate side;

e) a pin inserted through the first aperture of each exterior extension and the second aperture of each interior extension of the first connector and the second connector, the pin coupling the first connector to the second connector; and, f) wherein at least one of the exterior extensions and the interior extension is formed of steel having a grain structure elongated in a direction of rolling that is substantially perpendicular to at least one of the first base and the second base, respectively.

10. The column connector system of claim 9, wherein the second interior plate side of the first connector is positioned adjacent to the other of the first side and the second side of the other exterior extension of the first connector and wherein the second exterior plate side of the first exterior plate is positioned adjacent the first side of the at least one interior extension of the second connector and the first exterior plate side of the second exterior plate is positioned adjacent the second side of the at least one interior extension of the second connector.

11. The column connector system of claim 9, wherein the first connector further comprises:

at least one interior extension, wherein the interior plate of the first connector is disposed between and coupled to the interior extension and at least one exterior extension, the second interior plate side being positioned adjacent to one of the first side and the second side of the interior extension, the interior plate base being aligned substantially in a plane with the second base of the interior extension of the first connector;

another interior plate disposed between and coupled to the interior extension and the other exterior extension, the another interior plate having:

another interior plate base aligned substantially in a plane with the first base of the first extensions and the second base of the interior extension;

another first interior plate side perpendicular to the another interior plate base, the another first interior plate side being positioned adjacent to the other of the first side and the second side of the exterior extension; and, another second interior plate side perpendicular to the interior plate base, the another second interior plate side being spaced apart from the another first interior plate side, the another second interior plate side being positioned adjacent to the other of the first side and the second side of the interior extension; and, wherein the second connector further comprises:

another interior extension;

at least one interior plate disposed between and coupled to the interior extension and the another interior extension of the second connector, the interior plate base being aligned in a plane with each of the second bases of the interior extensions and the exterior plate bases of the second connector, the first interior plate side being positioned adjacent to the second side of one of the interior extensions, and the second interior plate side of the second connector being positioned adjacent to the first side of the other interior extension.

12. The column connector system of claim 9, wherein the first connector further comprises a plurality of welds that couple the interior plate to at least one of the exterior extensions and wherein the second connector further comprises a plurality of welds that couple at least one of the exterior plates to the interior extension.

13. The column connector system of claim 9, wherein the interior plate further comprises:

an interior plate surface spaced laterally apart from the interior plate base;

an interior plate top extending away from the interior plate base, the interior plate top intersecting the first interior plate side and the second interior plate side;

an interior plate bottom extending away from the interior plate base, the interior plate bottom intersecting the first interior plate side and the second interior plate side, the interior plate bottom being spaced apart from the interior plate top;

a first surface that extends away from the interior plate base, the interior plate surface, the interior plate top, and the interior plate bottom until the first surface meets the first interior plate side; and, a second surface that extends away from the interior plate base, the interior plate surface, the interior plate top, and the interior plate bottom until the second surface meets the second interior plate side; and, wherein each exterior plate includes:

an exterior plate surface spaced laterally apart from the exterior plate base;

an exterior plate top extending away from the exterior plate base, the exterior plate top intersecting the first exterior plate side and the second exterior plate side;

an exterior plate bottom extending away from the exterior plate base, the exterior plate bottom intersecting the first exterior plate side and the second exterior plate side, the exterior plate bottom being spaced apart from the exterior plate top; and, a first surface that extends away from the exterior plate base, the exterior plate surface, the exterior plate top, and the exterior plate bottom until the first surface of the exterior plate meets one of the first exterior plate side and the second exterior plate side.

14. The column connector system of claim 9, wherein at least a part of the first connector mounting surface is welded to the first column segment and at least a part of the second connector mounting surface is welded to the second column segment.

15. The column connector system of claim 9, wherein at least one of the first connector mounting surface and the second connector mounting surface includes at least one hole configured to align at least one of the first connector to the first column segment and the second connector to the second column segment.

16. A boom connector system for a crane having a boom with multiple segments coupled together with the boom connector system, the crane having an upper works rotatably mounted on a lower works, the upper works including a load hoist winch, the boom connector system comprising:

a) a first boom segment having a first end and a second end;

b) at least a second boom segment having a first end and a second end;

c) a first connector on the second end of the first boom segment, the first connector including:

two exterior extensions, each exterior extension having:

a first base;

a first side perpendicular to the first base;

a second side perpendicular to the first base, the second side being spaced apart from the first side; and, a first aperture through the exterior extension;

at least one interior extension having:

a second base;

a first side perpendicular to the second base;

a second side perpendicular to the second base, the second side being spaced apart from the first side; and, a second aperture through the interior extension;

an interior plate disposed between and coupled to the interior extension and one of the exterior extensions, another interior plate disposed between and coupled to the interior extension and the other exterior extension, each of the interior plates having:

an interior plate base aligned substantially in a plane with the first base and the second base to form a first connector mounting surface;

a first interior plate side perpendicular to the interior plate base, the first interior plate side being positioned adjacent to the second side of the exterior extension; and, a second interior plate side perpendicular to the interior plate base, the second interior plate side being spaced apart from the first interior plate side, the second interior plate side being positioned adjacent to one of the first side and the second side of the interior extension;

d) a second connector on the first end of the second boom segment, the second connector including:

at least two interior extensions;

at least one interior plate disposed between and coupled to each of the two interior extensions of the second connector, the interior plate base being aligned in a plane with each of the first bases of the two interior extension of the second connector to form a second connector mounting surface, the first interior plate side being positioned adjacent to the second side of one of the interior extensions of the second connector, and the second interior plate side being positioned adjacent to the first side of the other interior extension of the second connector;

an exterior plate coupled to one of the interior extensions, another exterior plate coupled to the other interior extension, each of the exterior plates having:

an exterior plate base aligned substantially in a plane with the second base of each of the interior extensions of the second connector to form a second connector mounting surface;

a first exterior plate side perpendicular to the exterior plate base; and, a second exterior plate side perpendicular to the exterior plate base, the second exterior plate side being spaced apart from the first exterior plate side, the second exterior plate side being positioned adjacent to one of the first side and the second side of one of the interior extensions of the second connector;

e) a pin inserted through the first aperture of each exterior extension and the second aperture of each interior extension of the first connector and the second connector, the pin coupling the first connector to the second connector; and, f) wherein at least one of the exterior extensions and the interior extensions is formed of steel having a grain structure elongated in a direction of rolling that is substantially perpendicular to at least one of the first base and the second base, respectively.

17. The boom connector system of claim 16, wherein the first connector further comprises a plurality of welds that couple each of the interior plates to the interior extension and the respective exterior extensions and wherein the second connector further comprises a plurality of welds that couple each of the of the exterior plates to the respective interior extension and the interior extension to the interior plate.

18. The boom connector system of claim 16, wherein each interior plate further comprises:

an interior plate surface spaced laterally apart from the interior plate base;

an interior plate top extending away from the interior plate base, the interior plate top intersecting the first interior plate side and the second interior plate side;

an interior plate bottom extending away from the interior plate base, the interior plate bottom intersecting the first interior plate side and the second interior plate side, the interior plate bottom being spaced apart from the interior plate top;

a first surface that extends away from the interior plate base, the interior plate surface, the interior plate top, and the interior plate bottom until the first surface meets the first interior plate side; and, a second surface that extends away from the interior plate base, the interior plate surface, the interior plate top, and the interior plate bottom until the second surface meets the second interior plate side; and, wherein each exterior plate includes:

an exterior plate surface spaced laterally apart from the exterior plate base;

an exterior plate top extending away from the exterior plate base, the exterior plate top intersecting the first exterior plate side and the second exterior plate side;

an exterior plate bottom extending away from the exterior plate base, the exterior plate bottom intersecting the first exterior plate side and the second exterior plate side, the exterior plate bottom being spaced apart from the exterior plate top; and, a first surface that extends away from the exterior plate base, the exterior plate surface, the exterior plate top, and the exterior plate bottom until the first surface of the exterior plate meets the second exterior plate side.

19. The boom connector system of claim 16, wherein at least a part of the first connector mounting surface is welded to the first boom segment and at least a part of the second connector mounting surface is welded to the second boom segment.

20. The boom connector system of claim 16, wherein at least one of the first connector mounting surface and the second connector mounting surface includes at least one hole configured to align at least one of the first connector to the first boom segment and the second connector to the second boom segment.

* * * * *